US006427257B1

(12) United States Patent
Castellote

(10) Patent No.: US 6,427,257 B1
(45) Date of Patent: Aug. 6, 2002

(54) HIDDEN AIR JET WITH UNIDIRECTIONAL FLOW MECHANISM AND AIR MASSAGE SYSTEM INCLUDING AT LEAST ONE OF THESE JETS

(75) Inventor: Miguel Castellote, Beauce (CA)

(73) Assignee: C. G. Air Systemes, Inc, Beauce (CA)

( * ) Notice: Subject to any disclaimer, the term of this patent is extended or adjusted under 35 U.S.C. 154(b) by 0 days.

(21) Appl. No.: 09/728,109

(22) Filed: Nov. 30, 2000

(51) Int. Cl.[7] ..... A61H 33/00
(52) U.S. Cl. ..... 4/541.5; 4/541.1
(58) Field of Search ..... 4/541.1–541.6

(56) References Cited

U.S. PATENT DOCUMENTS

| | | | | | |
|---|---|---|---|---|---|
| 3,251,071 | A | * | 5/1966 | Wood | 4/514.5 |
| 3,467,969 | A | * | 9/1969 | Szekely | 4/514.5 |
| 4,672,692 | A | * | 6/1987 | Savage | 4/514.5 |
| 4,805,664 | A | * | 2/1989 | Mattei et al. | 4/541.6 |
| 4,901,379 | A | * | 2/1990 | Chalberg et al. | 4/514.5 |
| 5,381,563 | A | * | 1/1995 | Isabelle et al. | 4/541.5 |
| 5,546,617 | A | * | 8/1996 | Sandrin | 4/541.6 |
| 5,930,851 | A | * | 8/1999 | Brunelle | 4/541.5 |

FOREIGN PATENT DOCUMENTS

| | | | | |
|---|---|---|---|---|
| EP | 234723 | * | 9/1987 | 4/541.6 |
| FR | 2 680 970 | * | 3/1993 | 4/541.6 |
| GB | 2 114 021 | * | 8/1983 | 4/541.5 |
| GB | 2 176 101 | * | 12/1986 | 4/541.5 |
| GB | 2 201 342 | * | 9/1988 | 4/541.5 |

* cited by examiner

*Primary Examiner*—Charles R. Eloshway
(74) *Attorney, Agent, or Firm*—Vernon C. Maine; Scott J. Asmus; Maine & Asmus

(57) ABSTRACT

An air massage system of air jets for injecting pressurized air into bathtubs. Each air jet has a hollow body component and an inlet fitting between which is housed a unidirectional fluid flow device. The outlet end of the jet is mounted directly to the hidden surface of the bathtub wall over an air flow opening in the wall, by means of a flange on the hollow body with recesses for holding an adhesive for securing the air jet to the bathtub wall. The flange has an annular seat with blades extending radially outwardly from the seat defining recesses for holding adhesive. The flange has holes between the blades for introducing the adhesive in the recesses. The inlet ends of the air jets are connected to air distribution piping. The air jet has an annular seal between the upstream side of the mounting flange and the inlet fitting.

23 Claims, 4 Drawing Sheets

HIDDEN AIR JET WITH UNIDIRECTIONAL FLOW MECHANISM AND AIR MASSAGE SYSTEM INCLUDING AT LEAST ONE OF THESE JETS

BACKGROUND OF THE INVENTION

1. Field of the Invention

The present invention relates to air jets for bathtub air massage systems and, more particularly, to a new air jet adapted to increase hygienic conditions in the massage system's piping located upstream of the air jet.

2. Description of the Prior Art

The Channel system, e.g. as in the Ultra™ bathtub, consists in surrounding a bathtub with a fiberglass air cavity. Thirty to ninety holes of more or less ⅛" in diameter are defined through the bathtub. Air is propelled in the cavity by a blower and then escapes through each hole to create turbulence in the water.

Even though the air distribution system is hidden, water infiltrates the air cavity once the blower is turned off. In addition to this problem, the air cavity is also hermetically closed and is hard to reach under the bathtub, making this system difficult to clean and consequently not very hygienic. Also, holes are a very basic means to blow air. The fact that the thickness of the bathtub wall is thin does not allow for the pressurized air to pick up much velocity and a direction.

Also known is the Ultra-Jet™ system that comprises air jets connected by a solid piping network, and that is connected to the drain of the bathtub. The jets allow for an improved flow of air as they are connected to pipes and as they form tubes. This allows for a flow of air in a direction with an increased velocity in comparison with the previous system. In this system, the water infiltrates the piping network through the jets when the system is not operating. When the user opens the drain to empty the bathtub, a valve is automatically opened to drain the piping network.

In addition to the improvement over the Channel system regarding the flow of air, the draining of the piping network from the stagnant water provides an improvement in hygiene. However, the network is still in contact with the soiled water. Also, the Ultra-Jet™ system is not as discreet as the Channel system as jets fill the surface of the bathtub. These jets are protuberant, and may consequently be uncomfortable and in the way.

Applicant of the present Application has also developed an air massage system for bathtubs which includes a unidirectional flow mechanism, also referred to as a check valve, to its air jets. This feature ensures the piping network is dry throughout the operation of the system and, once the system is shut off, provides a real improvement over the existing systems with respect to hygiene. However, the air jets protrude on the surface of the bathtub.

SUMMARY OF THE INVENTION

It is therefore an aim of the present invention to provide an air jet, e.g. for bathtub air massage systems, that is discreet in visibility.

It is a further aim of the present invention to provide an air jet maintaining a high level of hygiene in the pressurized air piping located upstream thereof.

Therefore, in accordance with the present invention, there is provided an air jet for an air massage system for use with a bathtub having a wall defining opposite visible and hidden surfaces, at least one opening being defined through the wall, comprising a hollow body having inlet and outlet ends and a unidirectional flow device disposed therebetween, said outlet end being adapted to be mounted to the hidden surface of the wall of the bathtub opposite the opening, said inlet end being adapted to be in fluid communication with a source of pressurized air, said unidirectional flow device being disposed for allowing air therethrough only in a direction from said inlet to said outlet end and then through the opening in the wall of the bathtub, thereby preventing water in the bathtub from conveying through said air jet when pressurized air is not fed to said air jet.

Also in accordance with the present invention, there is provided an air massage system adapted to be mounted behind a bathtub having wall defining opposite visible and hidden surfaces, at least one opening being defined through the wall, said air massage system comprising:

a source of pressurized air;

an air distribution system for conveying pressurized air from said source of pressurized air to at least one air jet;

said air jet comprising a hollow body having inlet and outlet ends and a unidirectional flow device disposed therebetween, said outlet end being adapted to be mounted to the hidden surface of the wall of the bathtub opposite the opening, said unidirectional flow device being disposed for allowing air therethrough only in a direction from said inlet to said outlet end and then through the opening in the wall of the bathtub, thereby preventing water in the bathtub from conveying through said air jet when pressurized air is not fed to said air jet.

Still in accordance with the present invention, there is provided an air massage system in combination with a bathtub having wall defining opposite visible and hidden surfaces, at least one opening being defined through said wall, said air massage system being provided behind said wall and comprising:

a source of pressurized air;

an air distribution system for conveying pressurized air from said source of pressurized air to at least one air jet;

said air jet comprising a hollow body having inlet and outlet ends and a unidirectional flow device disposed therebetween, said outlet end being mounted to said hidden surface of said wall of said bathtub opposite said opening, said unidirectional flow device being disposed for allowing air therethrough only in a direction from said inlet to said outlet end and then through said opening in said wall of said bathtub, thereby preventing water in said bathtub from conveying through said air jet when pressurized air is not fed to said air jet.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
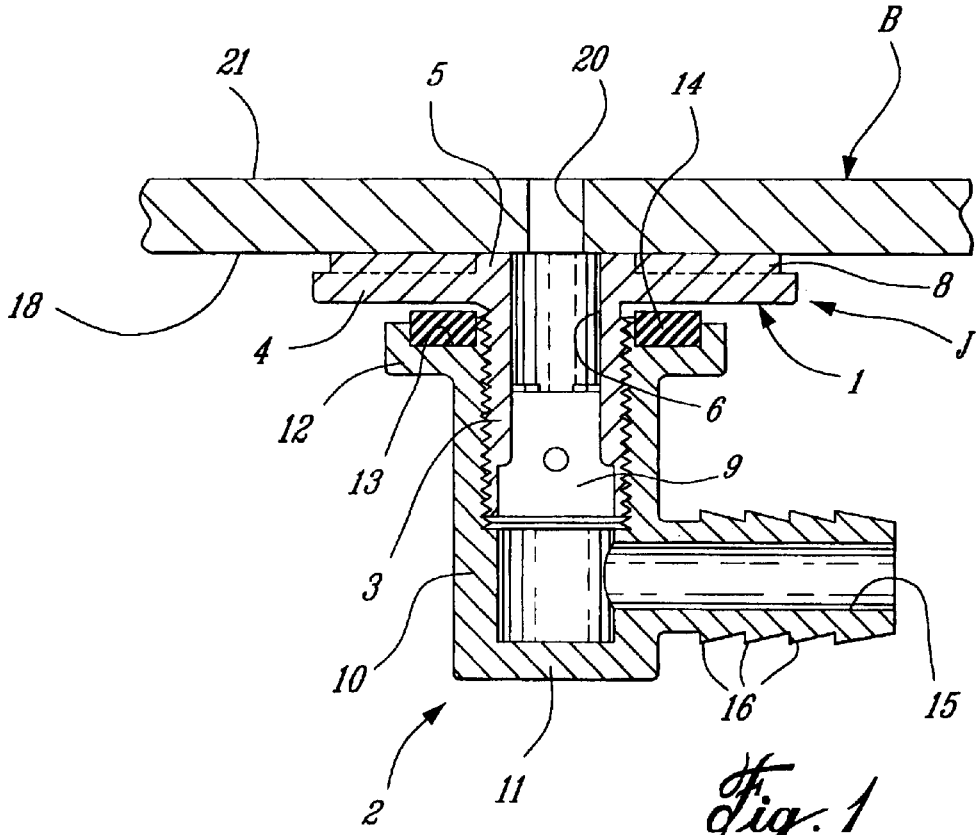
FIG. 1 is a cross-sectional elevational view of a hidden air jet in accordance with the present invention.
Figure 2:
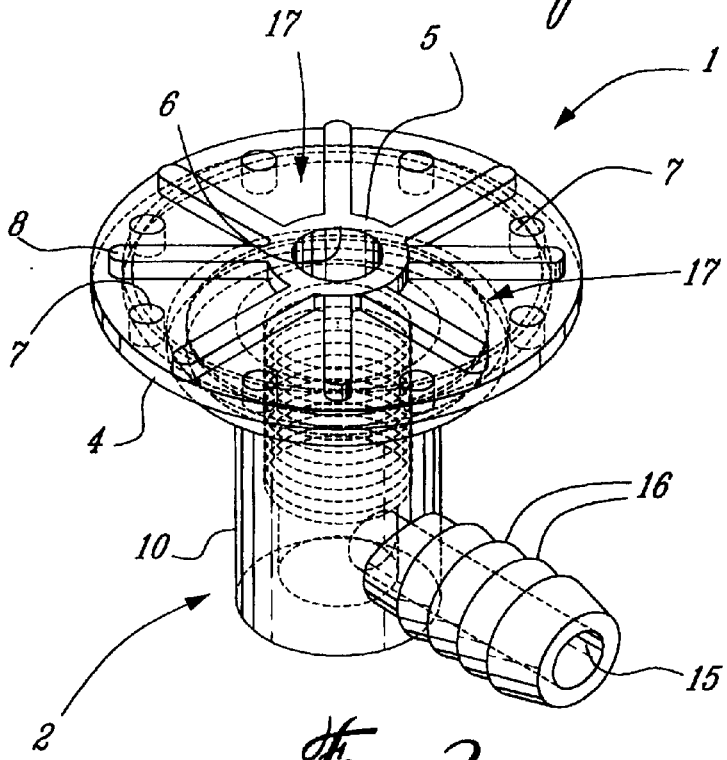
FIG. 2 is a perspective view of the hidden air jet of FIG. 1.

Referring to FIGS. 1 and 2, a hidden air jet J in accordance with the present invention is illustrated mounted against a hidden outer surface 18 of a bathtub B and to a fitting 2, such as an elbow (herein shown) or a Tee. The air jet J includes a jet body 1 that comprises an exteriorly threaded hollow tube 3 and an end flange 4. The flange 4 includes an annular seat 5 that extends around an inner wall 6 of the threaded hollow tube 3. The flange 4 is pierced with a number of holes 7 distributed equidistantly along the periphery of the flange 4. The flange 4 further includes a plurality of blades 8 extending radially from an outer surface of the annular seat 5 and between the holes 7. A unidirectional flow mechanism 9 is provided within the hollow tube 3 and can take the form of any water non-return device.

The elbow fitting 2 comprises an interiorly tapped hollow tube 10, closed at an end 11. A flange 12 is provided at a distal outlet of the tapped hollow tube 10, opposed from closed end 11. The flange 12 defines an annular groove 13 upon which rests an annular seal 14. A proximal inlet 15 of the fitting 2 extends laterally from the tapped hollow tube 10, and comprises a number of successive and parallel exterior annular wedges 16.

The jet body 1 and the elbow fitting 2 are assembled by screwing the threaded hollow tube 3 of the jet body 1 with the tapped hollow tube 10 of the elbow fitting 2. The annular seal 14 ensures the sealing of this assembly. A sealing adhesive is injected through the holes 7 and fills the substantially triangular recesses 17 formed between the blades 8, the annular seat 5 and the flange 4. The sealing adhesive bonds and seals the flange 4 of the jet body 1 with the outer surface 18 of the bathtub B. The threaded hollow tube 3 is concentric with a hole 20 defined through a wall of the bathtub B, i.e. from a visible inner surface 21 thereof to the hidden surface 18 thereof.

A flexible pipe (such as pipes 30 in FIG. 3) is fitted over the inlet 15. The annular wedges 16 stretches the flexible pipe diametrically outwardly to provide a sealed fit between the flexible pipe and the inlet 15.

With the flexible pipe fitted over the inlet 15 of the tapped hollow tube 10, the tapped hollow tube 10 and the threaded hollow tube 3 joined tightly, and the flange 4 of the jet body 1 bonded to the outer surface 18 of the bathtub B (with the threaded hollow tube 3 concentric with the hole 20), the hidden air jet J is ready for operation.

Air is blown through the flexible pipe and enters the hidden air jet J by the inlet 15. It fills the tapped hollow tube 10 and builds sufficient pressure to open and flow through the unidirectional flow mechanism 9. Then, it exits in the bathtub B through the hole 20 and creates a turbulence in the water filling the bathtub B.

Figure 3:
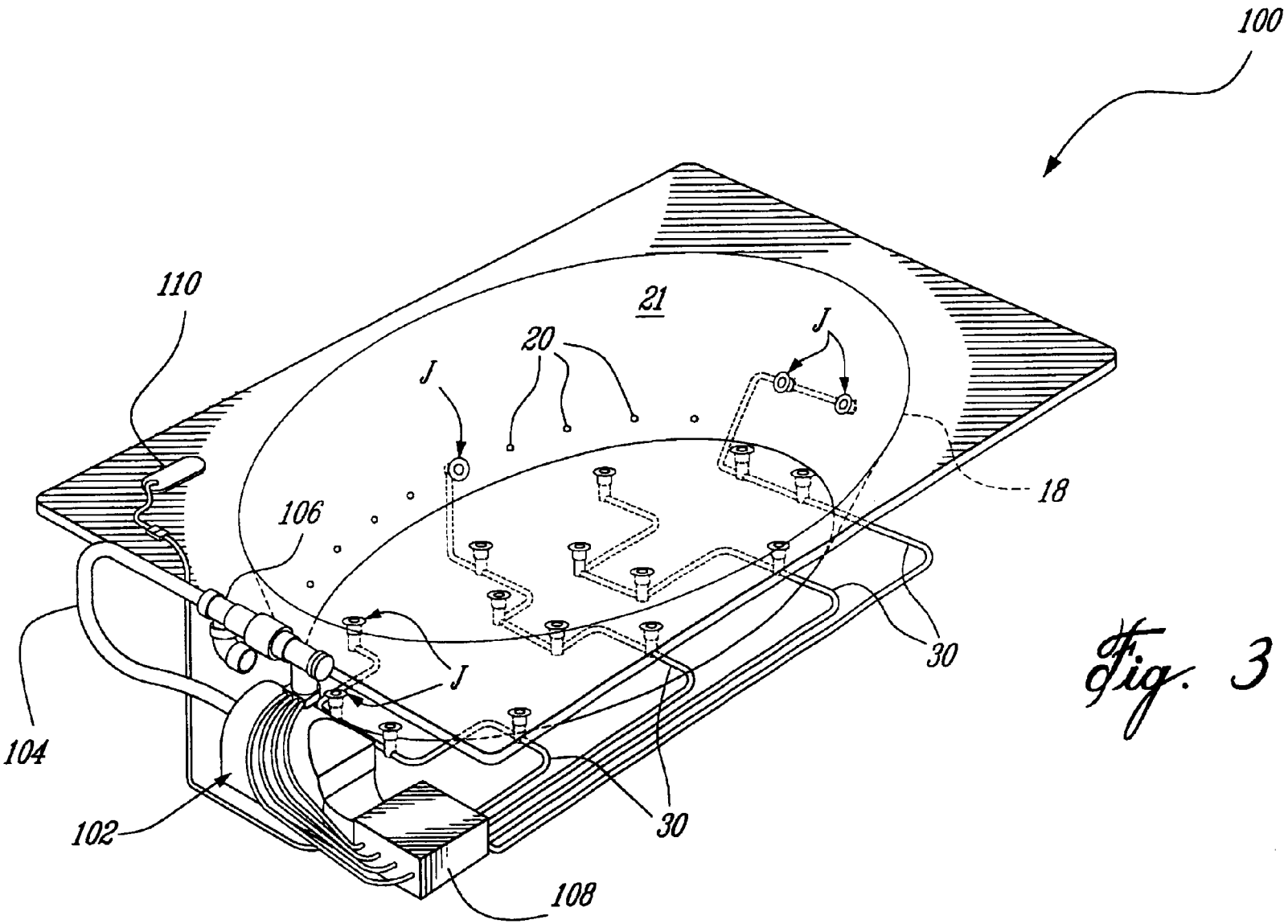
FIG. 3 is a schematic perspective view of an air massage system with sequencer and provided with a plurality of air jets of the present invention.

The present air jet J can be used in a variety of bathtubs where turbulence is desired in the bathtub water. For instance, FIG. 3 illustrates a bathtub 100 embodying an air massage system which includes a blower 102 (which may enclose a heating element), a flexible or rigid main piping 104 connecting the blower 102 to a manifold 106, a sequencer 108, an electronic controller 110 and a series of rigid or flexible branch pipes, such as the aforementioned flexible pipe 30. A number of holes 20 are defined through the wall of the bathtub 100 and an air jet J is mounted to the hidden surface 18 of the bathtub 100 opposite each hole 20. The use of flexible or rigid branch pipes provides the present invention with versatility in the disposition, distribution and quantity of jets during installation.

Figure 4:
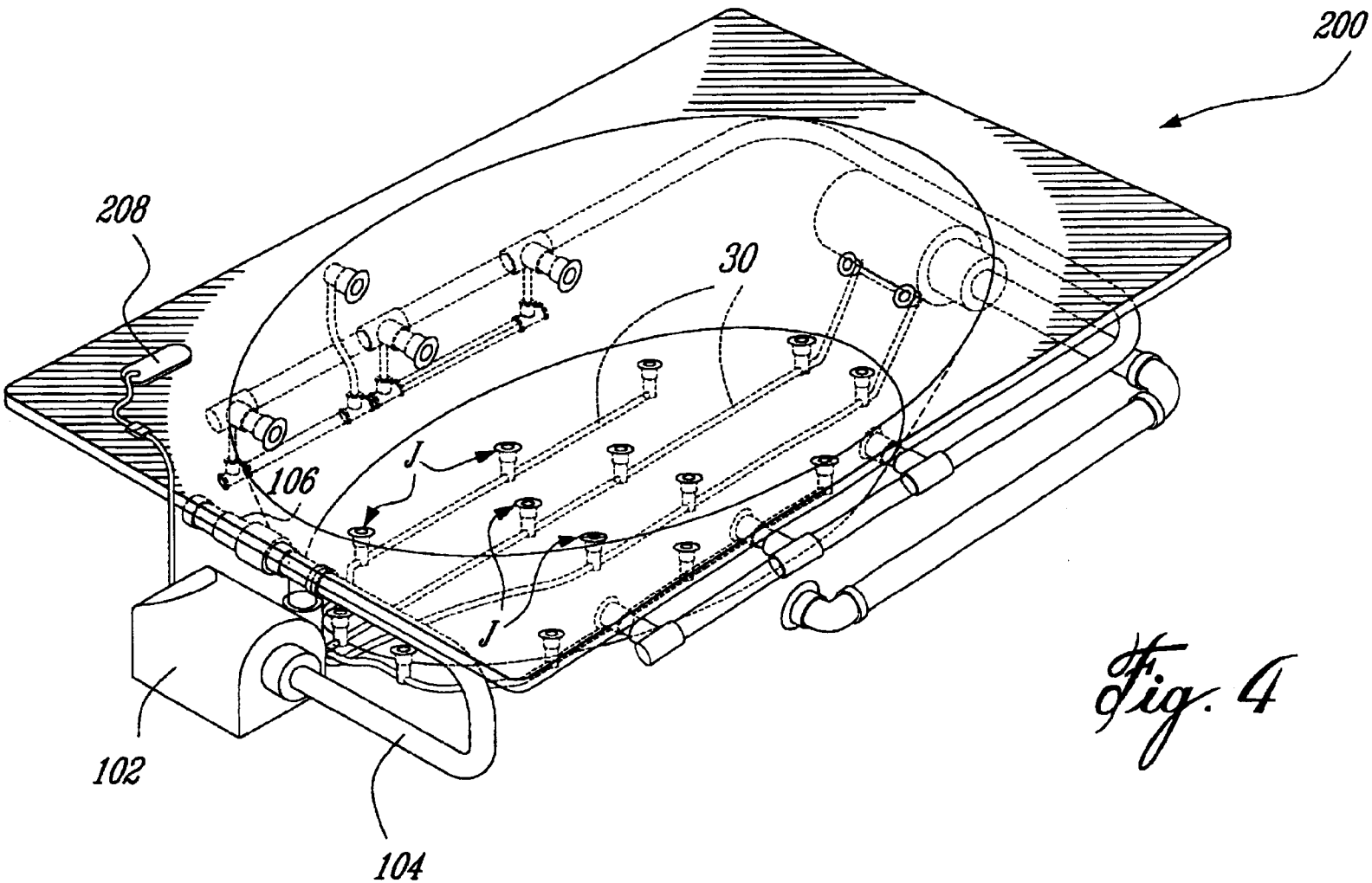
FIG. 4 is a schematic perspective view of an air massage system with a vortex system and provided with a plurality of air jets of the present invention.

In FIG. 4, there is shown a bathtub 200 provided with an air massaging system and a vortex system, the air massaging system being provided with a series of air jets J. The bathtub 200 includes, as for the bathtub 100 of FIG. 3, a blower 202, a main piping 204 connecting the blower 202 to a manifold 206, an electronic controller 208 and a series of distribution pipes 30 onto which are mounted the air jets J, as described hereinbefore in FIGS. 1 and 3.

Figures 5, 5A:
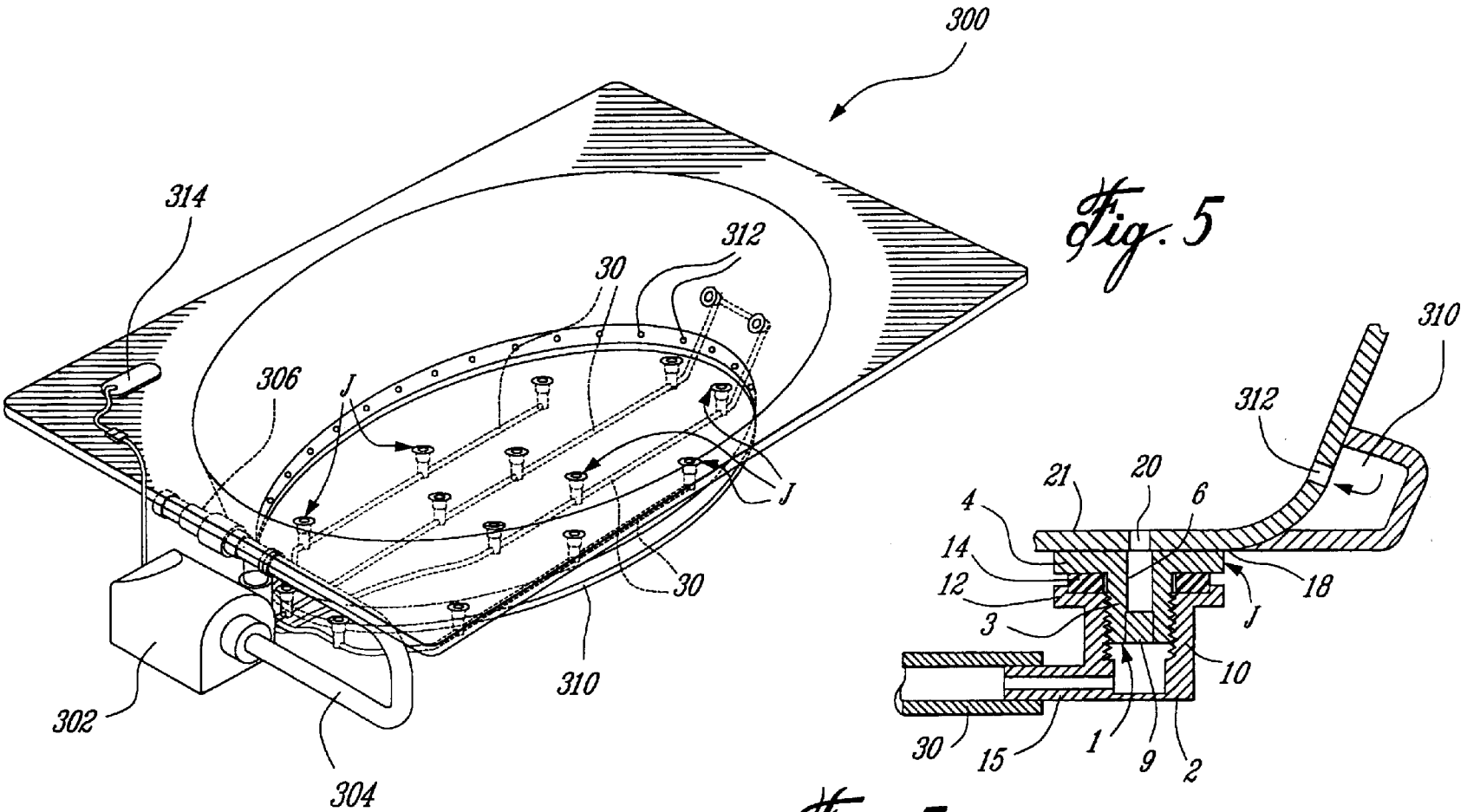
FIG. 5 is a schematic perspective view of a Channel air massage system provided with a plurality of air jets of the present invention.
FIG. 5A is a schematic vertical cross-sectional view of a bottom corner section of the bathtub and associated air distribution components.

In FIG. 5, a further bathtub 300 is illustrated of the Channel-type while incorporating concealed air jets J. The bathtub 300 includes a blower 302, a main piping 304 connecting the blower 302 to a manifold 306 which itself is connected to the distribution pipes 30 onto which are mounted the air jets J. In Fig. SA, a channel 310 is shown for conveying air through holes 312 defined along the channel 310 which extends peripherally around a bottom corner of the bathtub 300. At the bottom of the bathtub 300, various holes 20 are defined which are in communication with the air jets J and with the flexible pipes 30. The blower 302 is activated by an electronic controller 314. A variation of the Channel-type bathtub replaces the channel 310 by a cavity substantially extending along the hidden outer surface 18 of the bathtub, thereby defining a plenum which in fact extends across the complete bottom of the bathtub and also possibly behind the side wall thereof. Similarly, the plenum conveys air through holes 312.

When the air jet J is used in a Channel-type bathtub, the hidden air jets J are disposed within the channel 310 or the plenum of the bathtub 300 and are bonded to the hidden outer surface 18 of the bathtub 300, whereby it is possible to remove the flexible pipes 30 and the elbow fittings 2, with the hidden air jets being simply fed with pressurized air contained in the channel or plenum while still preventing the infiltration of bathtub water in the channel 310.

In all of the above bathtubs 100, 200 and 300, the air massaging system is completely hidden by way of the use of the air jets J of the present invention which only leaves the holes 20 of this air massaging system to be visible. Any air massage system combining any of the features of bathtubs 100, 200 and 300 can benefit from using the present air jet J.

The jet J of the present invention is qualified as being hidden. With the bonding and sealing means described above, the only visible parts of the system from the inner surface 21 of the bathtubs B, 100, 200 and 300 are the holes 20.

The unidirectional flow mechanism 9 allows for the free release of air in the bathtub B. Once the air pressure in the flexible pipes is reduced, upon the end of operation of the system for example, the unidirectional flow mechanism 9 closes, thereby preventing the bathtub water from entering in the flexible pipes and so causing, e.g. by its stagnation, a contamination of the flexible pipes and the remaining piping network of the air massage system. As air is the sole fluid in contact with the flexible pipes and with the piping network of the air massage system, the hidden air jet ensures a high hygiene level.

The unidirectional flow mechanism 9 may have different configurations. It can be a check valve with a spring-loaded piston and/or one (or more) spring-loaded plastic, stainless steel, glass or rubber ball, with a rubber flap or flaps from another material, a magnetic valve, a flexible diaphragm, a combination of the above enumeration and/or any other unidirectional flow mechanism to ensure the water-tightness of the air jet J.

Also, the elbow fitting 2 can be replaced by a Tee fitting, or other. This configuration increases the flow of incoming air through the inlet of the hidden air jet J, and consequently, the turbulence in the bathtub B.

I claim:

1. An air jet for an air massage system for use with a bathtub having a wall defining opposite visible and hidden surfaces, at least one opening being defined through the wall, comprising a hollow body having inlet and outlet ends and unidirectional flow device disposed there between, said outlet end comprising a flange having an annular seat disposed around an inner wall of said hollow body and blades extending radially outwardly from said annular seat, with recesses extending between said blades and outwardly of said annular seat, said blades and said annular seat being adapted to contact the hidden surface, said inlet end being adapted to be in fluid communication with a source of pressurized air, said unidirectional flow device being disposed for allowing air there through only in a direction from said inlet to said outlet end and then through the opening in the wall of the bathtub, thereby preventing water in the bathtub from conveying through said air jet when pressurized air is not fed to said air jet.

2. The air jet for an air massage system as defined in claim 1, wherein said recesses are configured for receiving an adhesive for securing said, flange to the hidden surface of the wall of the bathtub.

3. The air jet for an air massage system as defined in claim 1, wherein said flange defines a number of holes between said blades for introducing adhesive in said recesses from an upstream side of said flange.

4. The air jet for an air massage system as defined in claim 1, wherein said hollow body defines an exterior thread adapted to be connected to an air distribution piping of the air massage system.

5. The air jet for an air massage system as defined in claim 4, wherein said exterior thread is adapted to be threadably connected to a fitting of the air distribution piping of the air massage system.

6. The air jet for an air massage system as defined in claim 5, further comprising an annular seal adapted to be sandwiched between an upstream side of a flange provided at said outlet end of said hollow body and a further flange provided at a downstream end of the fitting.

7. The air jet for an air massage system as defined in claim 1, wherein the unidirectional flow device comprises at least one of a spring-loaded piston, a spring-loaded ball, a flap, a magnetic valve and a flexible diaphragm.

8. An air massage system adapted to be mounted behind a bathtub having wall defining opposite visible and hidden surfaces, at least one opening being defined through the wall, said air massage system comprising:

a source of pressurized air;

an air distribution system for conveying pressurized air from said source of pressurized air to at least one air jet;

said air jet comprising a hollow body having inlet and outlet ends and unidirectional flow device disposed there between, said outlet end comprising a flange having an annular seat disposed around an inner wall of said hollow body and blades extending radially outwardly from said annular seat, with recesses extending between said blades and outwardly of said annular seat, said blades and said annular seat being adapted to contact the hidden surface, said unidirectional flow device being disposed for allowing air there through only in a direction form said inlet to said outlet end and then through the opening in the wall of the bathtub, thereby preventing water in the bathtub form conveying through said air jet when pressurized air is not fed to said air jet.

9. The air massage system as defined in claim 8, wherein said recesses are configured for receiving an adhesive and sealingly securing said flange to the hidden surface of the wall of the bathtub.

10. The air massage system as defined in claim 8, wherein said flange of said air jet defines a number of holes between said blades for introducing said adhesive in said recesses from an upstream side of said flange.

11. The air massage system as defined in claim 8, wherein said air distribution system comprises at least one pipe for connecting in fluid communication said source of pressurized air to said air jet, at least a section of said pipe of said air distribution system connected to said air jet being flexible.

12. The air massage system as defined in claim 11, wherein said hollow body defines an exterior thread adapted to be connected to said pipe of said air distribution system.

13. The air massage system as defined in claim 12, wherein said air distribution system comprises a fitting adapted to be connected in fluid communication with said exterior thread of said air jet.

14. The air massage system as defined in claim 13, wherein said air jet comprises an annular seal adapted to be sandwiched between an upstream side of a flange provided at said outlet end of said hollow body and a further flange provided at a downstream end of said fitting.

15. An air massage system in combination with a bathtub having wall defining opposite visible and hidden surfaces, at least one opening being defined through said wall, said air massage system being provided behind said wall and comprising:

a source of pressurized air;

an air distribution system for conveying pressurized air from said source of pressurized air to at least one air jet;

said air jet comprising a hollow body having inlet and outlet ends and a unidirectional flow device disposed there between, said outlet end comprising a flange having an annular seat disposed around an inner wall of said hollow body and blades extending radially outwardly from said annular seat, with recesses extending between said blades and outwardly of said annular seat, said blades and said annular seat contacting the hidden surface, said unidirectional flow device being disposed for allowing air there through only in a direction form said inlet to said outlet end and then through said opening in said wall of said bathtub, thereby preventing water in said bathtub from conveying through said air jet when pressurized air is not fed to said air jet.

16. The combination as defied in claim 15, said recesses having an adhesive therein sealingly securing said flange to said hidden surface of said wall of said bathtub.

17. The combination as defined in claim 16, wherein said flange of said air jet defines a number of holes between said blades for introducing said adhesive in said recesses from and upstream side of said flange.

18. The combination as defined in claim 15, wherein said air distribution system comprises at least one pipe connecting in fluid communication said source of pressurized air to said air jet, at least a section of said pipe of said air distribution system connected to said air jet being flexible.

19. The combination as defined in claim 18, wherein said hollow body defines an exterior thread connected to said pipe of said air distribution system.

20. The combination as defined in claim 19, wherein said air distribution system comprises a fitting connected in fluid communication with said exterior thread of said air jet.

21. The combination as defined in claim 15, wherein said air distribution system defines at least one channel extending along said hidden surface of said wall of said bathtub, thereby defining a passage for conveying air from said source of pressurized air to said air jet.

22. The combination as defined in claim 15, wherein said air distribution system comprises a plenum extending along said hidden surface of said wall of said bathtub for conveying air from said source of pressurized air to said air jet.

23. The combination as defined in claim 15, wherein said air massage system is used in combination with at least one of a vortex system and a channel-type system.

* * * * *